US011200799B2

(12) United States Patent
Vrabete et al.

(10) Patent No.: US 11,200,799 B2
(45) Date of Patent: Dec. 14, 2021

(54) TRAFFIC MANAGEMENT VIA INTERNET OF THINGS (IOT) DEVICES

(71) Applicant: INTEL CORPORATION, Santa Clara, CA (US)

(72) Inventors: Bradut Vrabete, Sixmilebridge (IE); Wen-Kuang Yu, Taipei (TW); Sam Hsu, Taipei (TW); Albert Wu, Taipei (TW); Richard Lin, Taipei (TW); Wilson Y. Lee, Taipei (TW)

(73) Assignee: Intel Corporation, Santa Clara, CA (US)

( * ) Notice: Subject to any disclaimer, the term of this patent is extended or adjusted under 35 U.S.C. 154(b) by 157 days.

(21) Appl. No.: 16/329,465

(22) PCT Filed: Sep. 30, 2016

(86) PCT No.: PCT/US2016/054845

§ 371 (c)(1),
(2) Date: Feb. 28, 2019

(87) PCT Pub. No.: WO2018/063345

PCT Pub. Date: Apr. 5, 2018

(65) Prior Publication Data

US 2019/0251837 A1 Aug. 15, 2019

(51) Int. Cl.

| | |
|---|---|
| ***G08G 1/01*** | (2006.01) |
| ***G08G 1/017*** | (2006.01) |
| ***G08G 1/081*** | (2006.01) |

(52) U.S. Cl.

CPC ..... *G08G 1/0145* (2013.01); *G08G 1/01* (2013.01); *G08G 1/017* (2013.01); *G08G 1/0116* (2013.01); *G08G 1/0133* (2013.01); *G08G 1/081* (2013.01)

(58) Field of Classification Search

CPC ..... G08G 1/0145; G08G 1/01; G08G 1/0133; G08G 1/0116; G08G 1/017; G08G 1/081; G08G 1/095; G08G 1/00; H04L 12/24; H04L 29/06

See application file for complete search history.

(56) References Cited

U.S. PATENT DOCUMENTS

| | | | |
|---|---|---|---|
| 6,427,113 | B1 | 7/2002 | Rahman |
| 2002/0008637 | A1 | 1/2002 | Lemelson et al. |
| 2008/0238720 | A1 | 10/2008 | Lee |

(Continued)

FOREIGN PATENT DOCUMENTS

| | | | |
|---|---|---|---|
| CN | 103810865 | * | 11/2012 |
| KR | 1020160091540 | A | 8/2016 |
| WO | 2018063345 | | 4/2018 |

OTHER PUBLICATIONS

Machine Translation CN 103810865 (Year: 2012).*

(Continued)

*Primary Examiner* — Anne Marie Antonucci

(74) *Attorney, Agent, or Firm* — Schwegman Lundberg & Woessner, P.A.

(57) ABSTRACT

An Internet of Things (IoT) technique for vehicular traffic management, including an IoT sensor to measure traffic data of vehicular traffic, a traffic analyzer to determine a traffic event based on the traffic data, and an IoT gateway to issue a response based on the traffic event.

24 Claims, 10 Drawing Sheets

300

(56) References Cited

U.S. PATENT DOCUMENTS

| | | | | |
|---|---|---|---|---|
| 2015/0134954 | A1 | 5/2015 | Walley et al. | |
| 2018/0053405 | A1* | 2/2018 | de Azevedo ..... | G08G 1/0112 |

OTHER PUBLICATIONS

Inetrnational Search Report and Writtten Opinion for related PCT/US2016/054845 filed Sep. 30, 2016, dated May 29, 2017, 15 pages.
"International Application Serial No. PCT US2016 054845, International Preliminary Report on Patentability dated Apr. 11, 2019", 14 pgs.

* cited by examiner

100

200

300

400

500

600

700

800

TRAFFIC MANAGEMENT VIA INTERNET OF THINGS (IOT) DEVICES

CROSS REFERENCE TO RELATED APPLICATIONS

Pursuant to 35 U.S.C. § 371, this application is the United States National Stage Application of International Patent Application No. PCT/US2016/054845, filed on Sep. 30, 2016, the contents of which are incorporated by reference as if set forth in their entirety herein.

TECHNICAL FIELD

The present techniques relate generally to Internet of Things (IoT), and more particularly, to traffic management via IoT devices.

BACKGROUND

One view of the internet is the connection of clients, such as personal computers, tablets, smart phones, servers, digital photo-frames, and many other types of devices to publicly-accessible data-centers hosted in server farms. However, this picture represents a small portion of the overall usage of the globally-connected network. A very large number of connected resources currently exist, but are not publicly accessible. Examples include corporate networks, private organizational control and monitoring networks spanning the globe, and peer-to-peer relays designed for anonymity.

The Internet of Things (IoT) may bring Internet connectivity to as many as 50 billion devices by 2020. For organizations, IoT devices may provide opportunities for monitoring, tracking, or controlling other devices and items, including further IoT devices, other home and industrial devices, items in manufacturing and food production chains, and the like. Further, the emergence of IoT networks has served as a catalyst for profound change in the evolution of the internet. In the future, the internet is likely to evolve from a primarily human-oriented utility to an infrastructure where humans may eventually be minority actors in an interconnected world of devices.

Vehicular traffic can be problematic along busy streets including at congested intersections. Also, traffic accidents and bad weather can adversely affect traffic. Further, emergency vehicles sometimes require unimpeded access. The intersections of streets can have one or more traffic lights.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
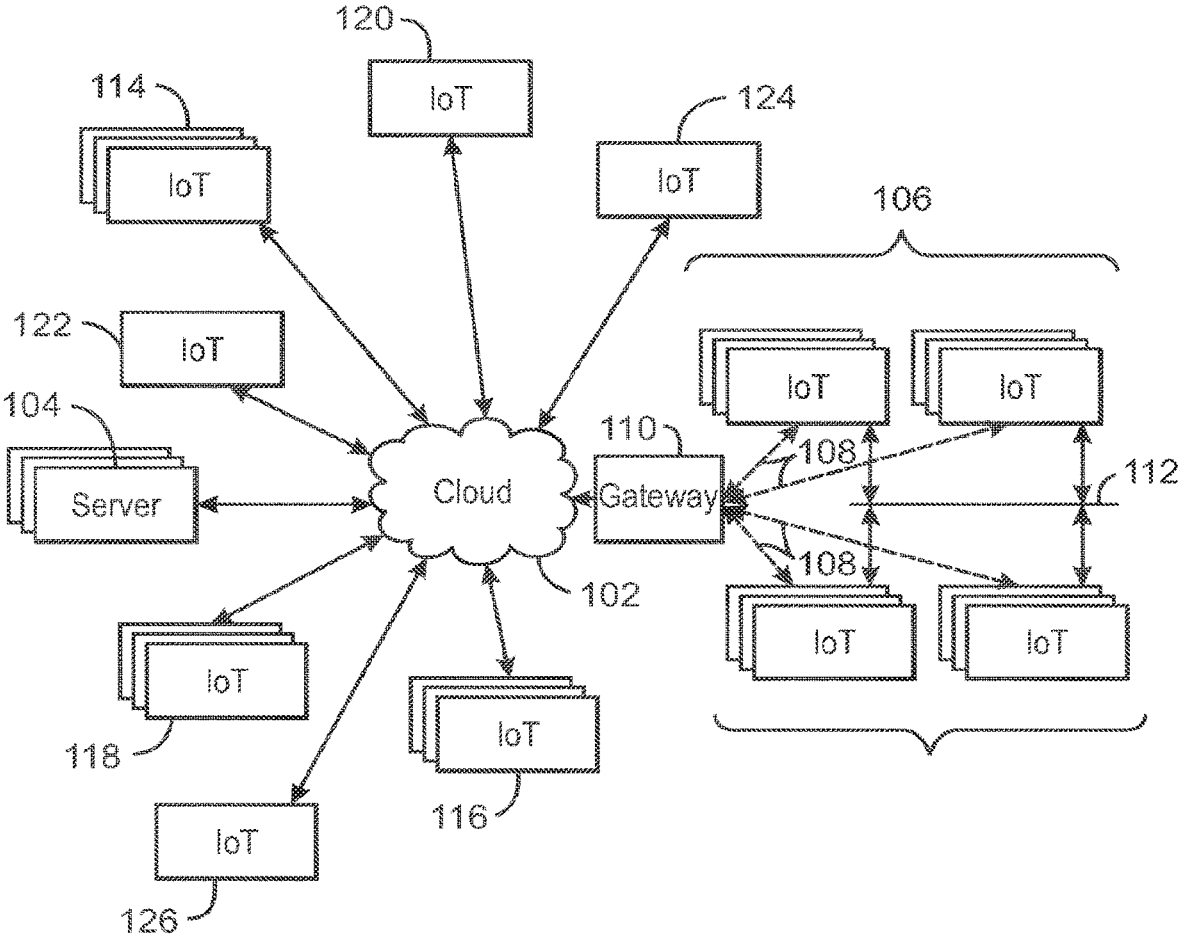
FIG. 1 is a drawing of a cloud computing network, or cloud, in communication with a number of Internet of Things (IoT) devices in accordance with embodiments of the present techniques.

The present techniques may include a system and method for hierarchical and adaptive traffic management. In certain embodiments, the timing of a traffic light is variable depending of traffic conditions. The techniques may involve image recognition, IoT gateways, analytics including edge analytics, and so on. A "green light" concept for timing a group of street lights may be such that lights in the principal direction remain green, i.e., traffic in the principal direction does not stop unless a vehicle is detected in the cross direction. In other words, the street lights can detect a vehicle in a cross-direction and change the light color in the principal direction to red so that the traffic in the principle direction stops. Certain embodiments provide for new traffic-light timing that is dynamic and measurement-based. A new and dynamic hierarchy for traffic lights is discussed below.

Conventional traffic management systems are generally not adaptive and may use a top-down concept. Unfortunately, the result of these past solutions is the inability to adapt to real life conditions, unexpected events, a spike in traffic, and the like. The management is more-or-less scheduled-based or with limited reactive behavior. In contrast, the present techniques may be based, for example, on real-time traffic data and traffic management cells that share information. Traffic-management decisions may be a function of that information. Smart vehicles and smart devices on pedestrians may be involved.

In certain embodiments, the amount of time a traffic light shows a green light in a direction is changed so the traffic is more efficiently managed. The traffic is detected and measured by sensors at each intersection or choke point. The sensors may include cameras, radar, infrared (IR), etc. A dynamic network of traffic lights is identified and the duration of each traffic light is increased or decreased depending on where the majority of traffic is going. This happens in real time and the route changed according to the reality in the traffic. The network may consist of reading points for both normal streets and motorways. For example, exits from motorways, if not cleared properly, creates traffic jams on motorways, leading to pollution, accidents delays, etc.

The techniques may beneficially impact several aspects of traffic management. For instance, the traffic may be improved or optimized in real time based on readings from sensors. The sensors give data of what is occurring in the field. In some examples, the techniques can be advantageously employed with existing infrastructure. In other words, traffic lights can be retrofitted. Moreover, again, the traffic may be monitored in real time on most or all traffic lights or other points. The data may be sent to a server and analyzed. The analysis may predict changes in traffic and the response may be proactive in addition to reactive. Specific examples are discussed below with respect to FIGS. 3-7. Examples of architecture and topology generally with regard to the present techniques are discussed with respect to FIGS. 1 and 2.

The internet of things (IoT) is a concept in which a large number of computing devices are interconnected to each other and to the Internet to provide functionality and data acquisition at very low levels. As used herein, an IoT device may include a semiautonomous device performing a function, such as sensing or control, among others, in communication with other IoT devices and a wider network, such as the Internet. Often, IoT devices are limited in memory, size, or functionality, allowing larger numbers to be deployed for a similar cost to smaller numbers of larger devices. However, an IoT device may be a smart phone, laptop, tablet, or PC, or other larger device. Further, an IoT device may be a virtual device, such as an application on a smart phone or other computing device. IoT devices may include IoT gateways, used to couple IoT devices to other IoT devices and to cloud applications, for data storage, process control, and the like.

Networks of IoT devices may include commercial and home automation devices, such as water distribution systems, electric power distribution systems, pipeline control systems, plant control systems, light switches, thermostats, locks, cameras, alarms, motion sensors, and the like. The IoT devices may be accessible through remote computers, servers, and other systems, for example, to control systems or access data.

The future growth of the Internet may include very large numbers of IoT devices. Accordingly, as described herein, a number of innovations for the future Internet address the need for all these layers to grow unhindered, to discover and make accessible connected resources, and to support the ability to hide and compartmentalize connected resources. Any number of network protocols and communications standards may be used, wherein each protocol and standard is designed to address specific objectives. Further, the protocols are part of the fabric supporting human accessible services that operate regardless of location, time or space. The innovations include service delivery and associated infrastructure, such as hardware and software. The services may be provided in accordance with the Quality of Service (QoS) terms specified in service level and service delivery agreements. The use of IoT devices and networks present a number of new challenges in a heterogeneous network of connectivity comprising a combination of wired and wireless technologies as depicted in FIGS. 1 and 2.

Figure 2:
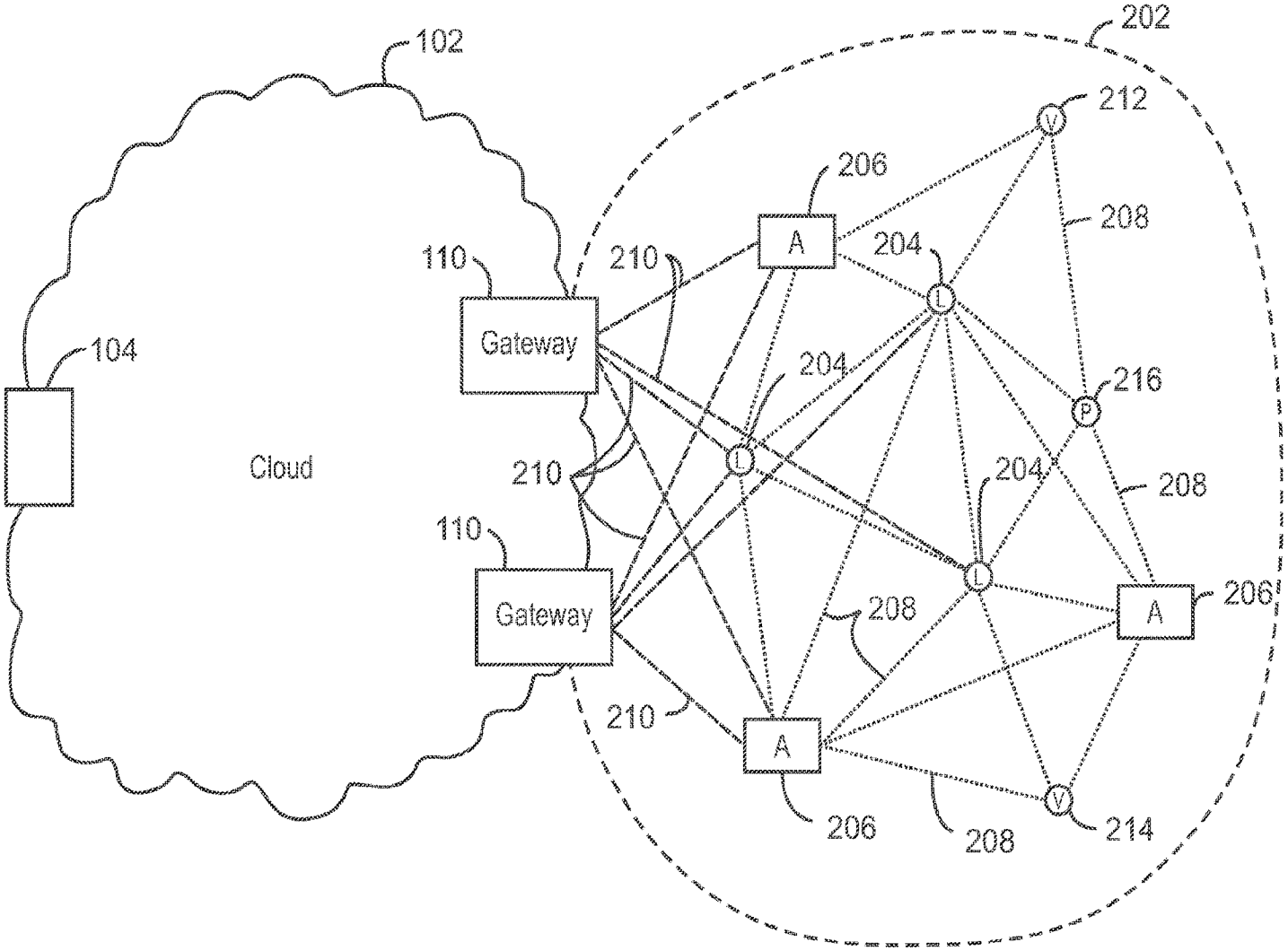
FIG. 2 is a drawing of a cloud computing network, or cloud, in communication with a mesh network of IoT devices, which may be termed a fog device, operating at the edge of the cloud in accordance with embodiments of the present techniques.

FIG. 1 is a drawing of a cloud computing network, or cloud 102, in communication with a number of Internet of Things (IoT) devices. The cloud 102 may represent the Internet, or may be a local area network (LAN), or a wide area network (WAN), such as a proprietary network for a company. The cloud 102 may be in contact with one or more servers 104 that may provide command and control functions or consume data from the IoT devices. The IoT devices may include any number of different types of devices, grouped in various combinations. For example, a traffic control group 106 may include IoT devices along streets in a city. These IoT devices may include stoplights, traffic flow monitors, cameras, weather sensors, and the like. The traffic control group 106, or other subgroups, may be in communication with the cloud 102 through wireless links 108, such as low power wide area (LPWA) links, and the like. Further, a wired or wireless sub-network 112 may allow the IoT devices to communicate with each other, such as a local area network, wireless local area network, and the like. The IoT devices may use another device, such as a gateway 110, which may function as an aggregator or aggregation device, to communicate with the cloud 102.

Other groups of IoT devices may include temperature sensors 114, remote weather stations 116, alarm systems 118, automated teller machines 120, alarm panels 122, or moving vehicles, such as emergency vehicles 124 or drones 126, among many others. Each of these IoT devices may be in communication with other IoT devices, with servers 104, or both.

As can be seen from FIG. 1, a large number of IoT devices may be communicating through the cloud 102. This may allow different IoT devices to request or provide information to other devices autonomously. For example, the traffic control group 106 may request a current weather forecast from a group of remote weather stations 116, which may provide the forecast without human intervention. Further, an emergency vehicle 124 may be alerted by an automated teller machine 120 that a burglary is in progress. As the emergency vehicle 124 proceeds towards the automated teller machine 120, it may access the traffic control group 106 to request clearance to the location, for example, by turning traffic lights to red to block cross traffic at an intersection in sufficient time for the emergency vehicle 124 to have unimpeded access to the intersection.

Clusters of IoT devices, such as the remote weather stations 116 or the traffic control group 106, may be equipped to communicate with other IoT devices as well as with the cloud 102. This may allow the IoT devices to form an ad-hoc network between the devices, allowing them to function as a single device, which may be termed a fog device discussed further with respect to FIG. 2.

FIG. 2 is a drawing 200 of a cloud computing network, or cloud 102, in communication with a mesh network of IoT devices, which may be termed a fog device 202, operating at the edge of the cloud 102. Like numbered items are as described with respect to FIG. 1. In this example, the fog device 202 is a group of IoT devices at a street intersection. The fog device 202 may be established in accordance with specifications released by the OpenFog Consortium (OFC), among others. These specifications allow the formation of a hierarchy of computing elements between the gateways 110 coupling the fog device 202 to the cloud 102 and endpoint devices, such as the traffic lights 204 and the data aggregators 206 in this example.

Traffic flow through the intersection may be controlled by three traffic lights 204 in this example. Analysis of the traffic flow and control schemes may be implemented by aggregators 206 that are in communication with the traffic lights 204 and each other through a mesh network. Data may be uploaded to the cloud 102, and commands may be received from the cloud 102, through gateways 110 that are in communication with the traffic lights 204 and the aggregators 206 through the mesh network.

Any number of communications links may be used in the fog device 202. Shorter-range links 208, for example, compatible with IEEE 802.15.4 may provide local communications between IoT devices that are proximate to the intersection. Longer-range links 210, for example, compatible with LPWA standards, may provide communications between the IoT devices and the gateways 110. To simplify the diagram, not every communications link 208 or 210 is labeled with a reference number.

The fog device 202 may be considered to be a massively interconnected network wherein a number of IoT devices are in communications with each other, for example, by the communication links 208 and 210. The network may be established using the open interconnect consortium (OIC) standard specification 1.0 released by the Open Connectivity Foundation™ (OCF) on Dec. 23, 2015. This standard allows devices to discover each other and establish communications for interconnects. Other interconnection protocols may also be used, including, for example, the optimized link state routing (OLSR) Protocol, or the better approach to mobile ad-hoc networking (B.A.T.M.A.N.), among many others.

Communications from any IoT device may be passed along the most convenient path between any of the IoT devices to reach the gateways 110. In these networks, the number of interconnections provide substantial redundancy, facilitating communications to be maintained, even with the loss of a number of IoT devices.

Not all of the IoT devices may be permanent members of the fog device 202. In the example in the drawing 200, three transient IoT devices have joined the fog device 202, a first vehicle 212, a second vehicle 214, and a pedestrian 216. In these cases, the IoT device may be built into the vehicles 212 and 214, or may be an App on a cell phone carried by the pedestrian 216.

The fog device 202 of the devices may be presented to clients in the cloud 102, such as the server 104, as a single device located at the edge of the cloud 102. In this example, the control communications to specific resources in the fog device 202 may occur without identifying any specific IoT device within the fog device 202. Accordingly, if an IoT device fails, other IoT devices may be able to discover and control a resource. For example, the traffic lights 204 may be wired so as to allow any one of the traffic lights 204 to control lights for the other traffic lights 204.

In some examples, the IoT devices may be configured using an imperative programming style, e.g., with each IoT device having a specific function and communication partners. However, the IoT devices forming the fog device 202 may be configured in a declarative programming style, allowing the IoT devices to reconfigure their operations and communications, such as to determine needed resources in response to conditions, queries, and device failures. This may be performed as transient IoT devices, such as the pedestrian 216, join the fog device 202. As the pedestrian 216 is likely to travel more slowly than the vehicles 212 and 214, the fog device 202 may reconfigure itself to ensure that the pedestrian 216 has sufficient time to make it through the intersection. This may be performed by forming a temporary group of the vehicles 212 and 214 and the pedestrian 216 to control the traffic lights 204. If one or both of the vehicles 212 or 214 are autonomous, the temporary group may instruct the vehicles to slow down prior to the traffic lights 204.

As the vehicles 212 and 214 and pedestrian 216 (the transient IoT devices), leave the vicinity of the intersection the fog device 202, the fog device 202 may reconfigure itself to eliminate those IoT devices from the network. As other transient IoT devices approach the intersection, the fog device 202 may reconfigure itself to include those devices.

The fog device 202 may include the traffic lights 204 for a number of intersections, such as along a street, along with all of the transient IoT devices along the street. The fog device 202 may then divide itself into functional units, such as the traffic lights 204 and other IoT devices proximate to a single intersection. This type of combination may enable the formation of larger IoT constructs in the fog device 202. For example, if an emergency vehicle joins the fog device 202, an emergency construct, or virtual device, may be created that includes all of the traffic lights 204 for the street, allowing control of the traffic flow patterns for the entire street. The emergency construct may instruct the traffic lights 204 along the street to stay red for opposing traffic and green for the emergency vehicle, expediting the passage of the emergency vehicle. Lastly, many other configurations and applications related to traffic are relevant and applicable.

Figure 3:
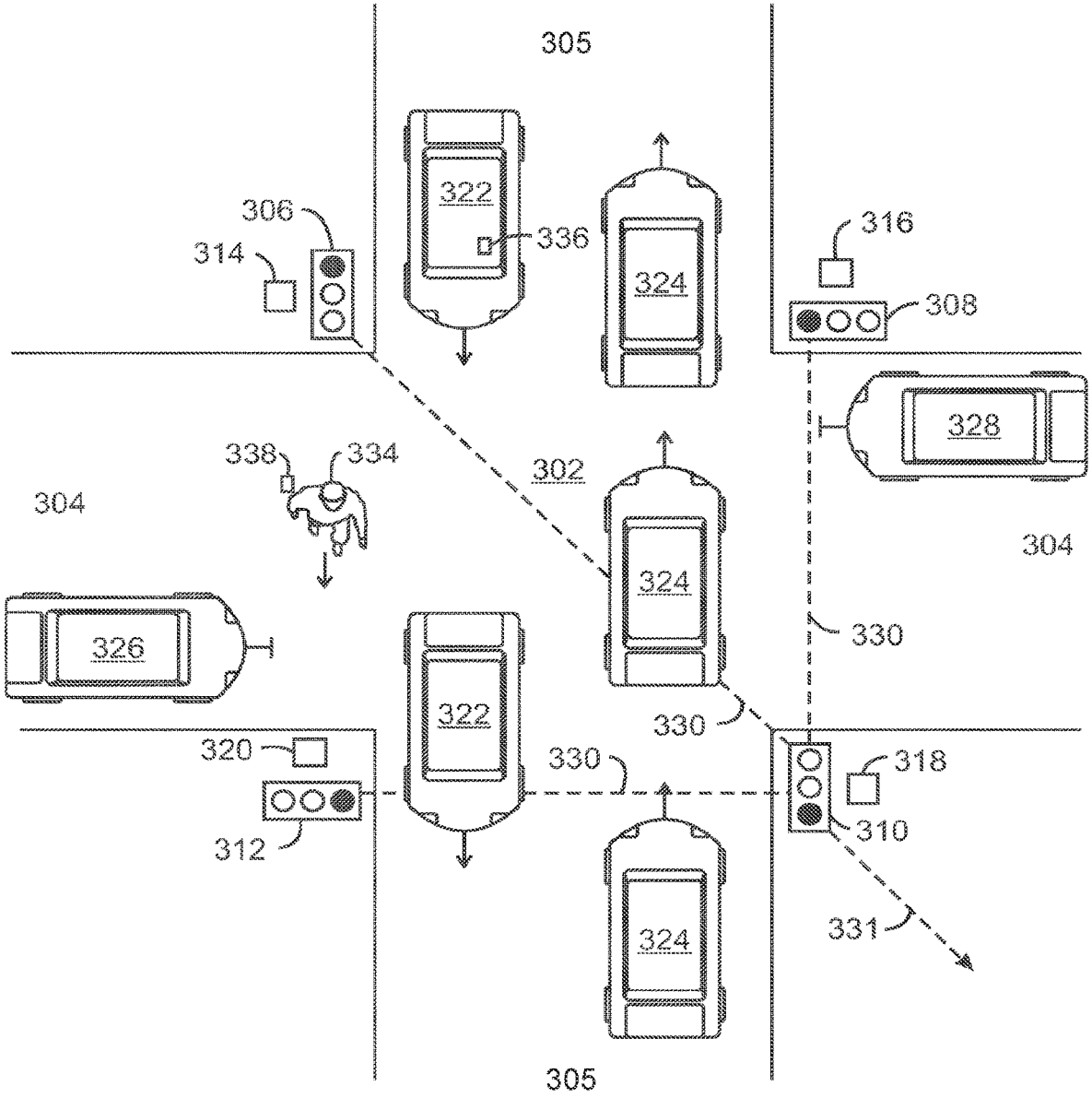
FIG. 3 is a drawing of a street intersection in accordance with embodiments of the present techniques.

FIG. 3 is an operational cell 300 in a traffic management system. The operational cell 300 may be an IoT system. In the illustrated example, the operational cell 300 is at a typical intersection 302 of streets 304 and 305. The operational cell 300 includes traffic lights 306, 308, 310, and 312, and associated sensors 314, 316, 318, and 320, respectively. The sensors 314, 316, 318, and 320 (e.g., IoT sensors) may be radar, IR, camera, traffic sensors in the road, etc., and may measure and record traffic data of the vehicles 322, 324, 326, 326. The vehicles 322, 324, 326, 326 may be motorized vehicles such as cars, trucks, and motorcycles, and may include bicycles, and so on.

In the illustrated example, the vehicles 322 are moving on street 305 in one direction having the traffic light 306 with a green light. The vehicles 324 are moving on street 305 in the other direction having the traffic light 310 with a green light. The vehicle 326 is stopped at the intersection 302 on the street 304 in one direction having the traffic light 312 with a red light. The vehicle 328 is stopped at the intersection 302 on the street 304 in the other direction having the traffic light 308 with a red light.

The sensors 314, 316, 318, and 320 measure and collect traffic data including detecting traffic going through the intersection, the number of vehicles waiting in each direction, the amount of time to clear the intersection 302 in a given direction, and so forth. The data and information may be stored in memory on the sensors, traffic lights, an IoT aggregation device or gateway device, server, remote computing device, and the like. A traffic light, sensor, or another computing device may be an aggregation device or IoT gateway device. The traffic lights 306, 308, 310, and 312 and/or sensors 314, 316, 318, and 320 may share the data and information with each other, such as via one or more IoT gateway devices. This information may also be fed to other operational cells, traffic lights, sensors, etc. at nearby intersections or locations, and so on, as indicated by arrow 331.

As indicated, the sensors or traffic lights at the intersection 302 may be configured as a gateway or primary controller gateway. In the example operational cell 300, the traffic light 312 is the primary controller gateway. The traffic light 312 as the gateway may feed timing instructions to the other traffic lights 306, 308, and 310. In some examples, the traffic light 312 or another gateway device has a traffic analyzer (e.g., code store in memory and executed by a processor) to analyze the traffic data and determine a traffic event based on the traffic data. In other examples, the traffic analyzer resides and is executed by a computing device remote from the intersection 302, such as at another operational cell or at a central location, and so on.

The determined traffic event may be related to traffic flow near or through the intersection 302. Indeed, the traffic event may be an assessment of or a conclusion about traffic flow. In some examples, the traffic event is traffic congestion or light traffic. Further, the traffic event may be an emergency, vehicle accident, hazardous event, road construction, and the like. In general, the traffic event may be an event beneficial or averse to traffic flow. The traffic event can be many different events and types of events.

Moreover, the vehicles may have an IoT device 336 in communication with the operating cell 300 such as with the primary controller gateway (e.g. the traffic light 312) of the operating cell 300. The vehicle IoT device 336 may be vehicle smart devices or vehicle smart capability, or a mobile device (e.g., smartphone, tablet, smartwatch, smart glasses, etc.) or mobile device application of an occupant of the vehicle 224, and so on. The vehicle IoT device 336 may receive information about the condition of the traffic or the intersection 302, including a warning.

For authorized entities, the IoT device 336 in or of the vehicle may also be employed to instruct, for example, the primary controller gateway 312. In one example, the IoT device 336 is in an emergency vehicle, and the occupant of the vehicle an emergency professional who instructs the operating cell 300 (e.g., through the primary controller gateway 312) via the IoT device 336 to adjust traffic flow through the intersection 302 to accommodate an emergency. In another example, the IoT device 336 is in a construction vehicle, and the occupant of the vehicle is road construction worker who instructs the primary controller gateway 312 via the IoT device 336 to adjust traffic flow through the intersection 302 to accommodate road construction at the intersection 302 or nearby.

A pedestrian 334 may also be considered in the operating cell 300. The traffic data collected via the sensors may incorporate data of the pedestrian such as position and movement of the pedestrian 334. The pedestrian 334 may have an IoT device 338 (e.g., smartphone, smartwatch, computer glasses, etc.) in communication with the operating cell 300.

The communication between sensors, traffic lights, gateways, IoT devices, etc. may via a low-power, low-range wireless protocol. The protocol may be Bluetooth® Low Energy or Institute of Electrical and Electronics Engineers (IEEE) 802.15.4 stack such as with ZigBee, WirelessHART, MiWi, and Thread specifications. Other protocols, including employment of a wireless access point (AP), are applicable.

In the illustrated example, in addition to the traffic light 312 as the gateway feeding timing instructions to the other traffic lights 306, 308, and 310, the traffic light 312 or another gateway device may issue a warning of the traffic event to the vehicle IoT device 336 or pedestrian IoT device 338. Indeed, the issued warning may generally be receivable by the IoT device or wireless device of the vehicle or pedestrian. Again, the primary controller gateway may not be a traffic light but instead a sensor or a computing device disposed near or at the intersection 302, or remote from the intersection 302. Lastly, the operational cell 300 may be an operational cell in a network of operational cells. Other similar operational cells may be communicatively coupled to the operational cell 300 and disposed at other intersections of streets different than the intersection 302.

Figure 4:
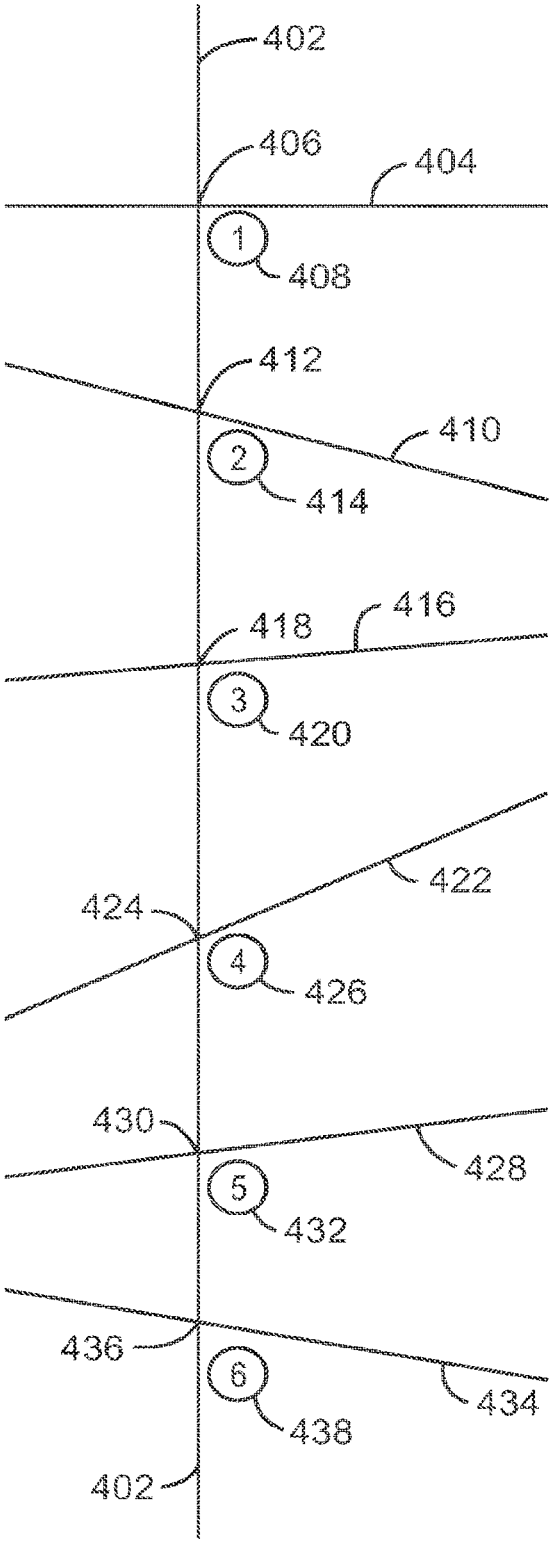
FIG. 4 is a drawing of a network of cells in accordance with embodiments of the present techniques.

FIG. 4 is a network 400, e.g., an IoT network, of operational cells such as the operating cell 300 discussed with respect to FIG. 3. FIG. 4 depicts a series of street intersections along a street 402. The street 402 may be labeled as the main boulevard. In other words, the primary flow of traffic may be along the street 402. As for the remaining streets, a street 404 crosses the street 402 at the intersection 406 which has an operational cell 408. A street 410 crosses the street 402 at the intersection 412 which has an operational cell 414. A street 416 crosses the street 402 at the intersection 418 which has an operational cell 420. A street 422 crosses the street 402 at the intersection 424 which has an operational cell 426. A street 428 crosses the street 402 at the intersection 430 which has an operational cell 432. Lastly, a street 434 crosses the street 402 at the intersection 436 which has an operational cell 438.

In the illustrated example, the six operational cells 408, 414, 420, 426, 432, and 438 may be in communication with each other via wired connections and/or wireless protocols. The wireless connections may include Wi-Fi Direct®, an access point router, cellular, and so on. The operational cells 408, 414, 420, 426, 432, and 438 may collectively form the IoT network 400 or an IoT system. One of the operational cells, for example operational cell 426, may be selected as a primary controller cell of the network 400. In some embodiments, the remaining operational cells may be configured and operate as a secondary controlled operational cell or quasi-secondary controlled (or semi-secondary controlled) operational cell.

Indeed, an operational cell can receive a timing option with respect to street lights from the primary controller operational cell. However, in certain embodiments, the secondary controlled operational cell can reject the timing option and instead rely on a timing option determined by the secondary controlled operational cell based on local traffic data at the local intersection. In some examples, a fallback position for each operational cell is a default timing for traffic lights. An operational cell can switch to the default timing in response to sensor malfunction, loss of connectivity with the network 400, or if the last policy applied from the primary controller requires the operational cell to rely on default timing, and so forth. The default timing may be applied as a reserve, for instance, with worst-case scenarios to revert to the default timing. In some examples, the default timing may be a typical schedule-based behavior for the traffic lights.

The networks and cells can work without connection to a central control point but may function better with a central control point. The traffic data collected via the sensors (e.g., sensors 314, 316, 318, and 320) by each operational cell 408, 414, 420, 426, 432, and 438 may be agglomerated at a computing device (e.g., aggregation device, traffic light, sensor, etc.) of the primary controlled operational cell and/or sent to a computing device (e.g., an aggregation device, server, etc.) at a remote or central location. This computing device at the primary controlled operational cell or central location may analyze the traffic data and predict vehicular traffic flow associated with the network 400 and other networks and streets. In response to the analysis and predictions, the computing device may formulate an improved or optimal timing schedule for the traffic lights at each of the operational cells and intersections in the network 400. The formulated timing may account for particular days and particular times in a given day. An aim may be to prevent or reduce traffic jams and congestion. A special use case may be the clearing of a particular route for emergencies. An emergency vehicle or entity may also be involved in controlling the traffic lights but the network 400 without human intervention may prepare and clear the route to better accommodate an emergency vehicle, and clear traffic backlog after passing of the emergency, and the like.

As mentioned, FIG. 4 depicts a network 400 having six operational cells. In the illustrated example, the operational cell 426 is the local primary controller, controlling the traffic-light timing at the intersection 424 and at the remaining intersections via the remaining operational cells so that traffic on the street 402 (e.g., main boulevard) has priority. The primary controller operational cell 426 may receive and utilize information from subordinate operational cells 408, 414, 420, 432, and 438. For instance, if the sensors at operational cell 432 detect too many vehicles waiting on the street 428 at the intersection 430, such information may be received by the primary controller operational cell 426. In response, the primary controller operational cell 426 may issue traffic-light timing instructions to the operating cells at the various intersections in the network 400 to slow or impede traffic on the main street 402. In an example with the street 404 as a freeway, the primary controller operational cell 426 may make decisions for traffic-light timing instructions for the network 400 to give priority to traffic exiting from the freeway 404 to the street 402 in response to traffic congestion on the freeway 404. In certain embodiments, the primary controller operational cell 426 has wired and/or wireless connections with other primary controller operational cells of other networks (not shown). Thus, the primary controller computing device (e.g., a traffic light, aggregation device, sensor, etc.) of the primary controller operational cell 426 can make decisions based on input from other networks.

Also, in some examples, the operating topology of the network 400 may change as a function of the traffic. For instance, if the traffic on the street 422 becomes heavy, then the directions of traffic, intersections, and operational cells along the street 422 may become a network. If so, the operational cell 426, for example, may become the primary controller of the network (not shown) along the street 422. The street 422 may be treated as a main street with primary traffic flow.

Further, the timing of traffic events may be taken into account. For example, a traffic event may be defined by or in an operational cell as discrete or as a plurality of discrete occurrences, each having a beginning and an end. The timing may include minutes, days, weeks, months, or longer. Also, a traffic event may be manually and arbitrarily set by a user, such as a planned maintenance or construction event. A graphical user interface (GUI) may facilitate such input. If so, the GUI may be at a remote computer, at a local primary controller gateway device, on a mobile device, on a vehicle dashboard display, and so forth. The GUI may have displayed input cells or components including for selections of timing and type of traffic events, blanks for instructions, and so forth. Moreover, in some examples, a multitude of events can be input and managed at the substantially the same time. Again, longer events may be complicated by immediate and intermediate discrete events.

In certain examples, events may be automatically recorded without user intervention. The events recorded may be a function of the IoT sensors in the system. The techniques may employ some of these sensor inputs to infer other events or indirect measurements. Further, in some examples, the events may not be treated as atomic or independent but instead analyzed together, and may be a function of the number of sensors installed in a particular system and other factors. Further, a traffic event, e.g., car crash, road construction, etc., may be set manually with a user turning on, for example, a gateway device as an emitter. The following cars can receive the notice early to avoid another crashes. The user can turn off the emitter once the event is complete or passed. A GUI may not be necessary. The gateway device or emitter can be configured, such as with buttons to select pre-defined messages and on/off switches, and the like. There generally may not be a significant limit to the number of events and event types for at least the reason event types and event messages can be configured.

In general, an event including a traffic event may be characterized as discrete or continuous, or some combination thereof. A discrete event may be a traffic jam, an emergency event, a construction event, or the like, while a continuous event may be the typical flow of traffic through an intersection, roadway, or the like. Time constants may be defined for discrete versus continuous, or for an implemented or labeled combination thereof of discrete and continuous.

Figure 5:
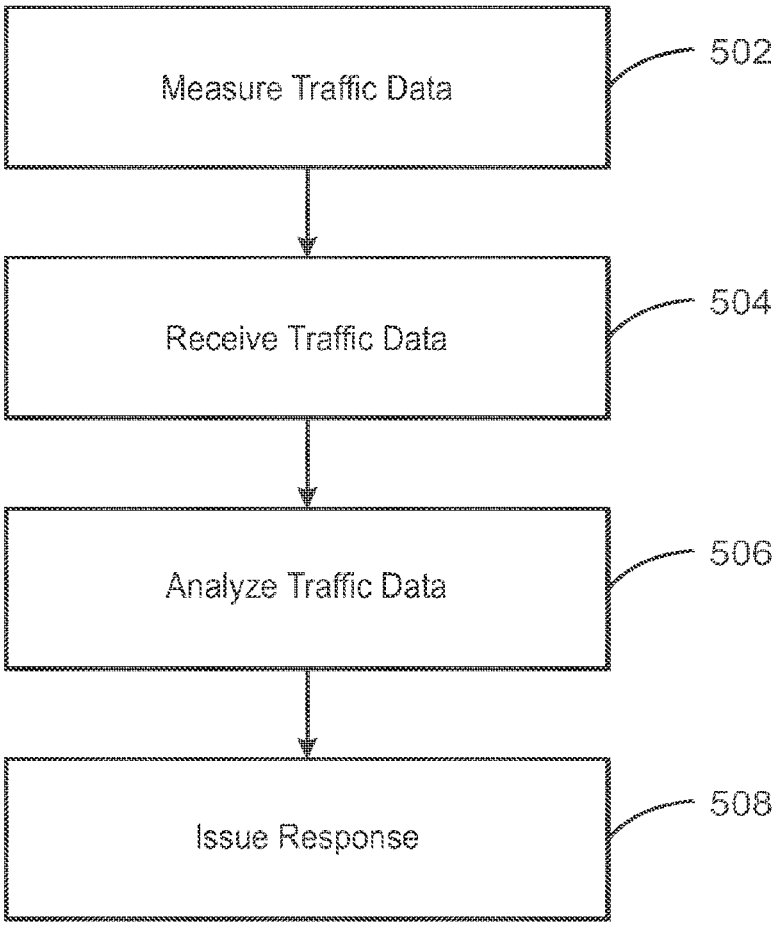
FIG. 5 is a block flow diagram of a method of traffic management in accordance with embodiments of the present techniques.

FIG. 5 is a method 500 of managing traffic via an IoT system. At block 502, traffic data of vehicular traffic at a street intersection is measure via an IoT sensor disposed near or at the street intersection. The IoT sensor may be radar, IR, a camera, traffic sensors in the road, etc., to measure and record traffic data of the vehicles at the intersection. The vehicles may be motorized vehicles such as cars or trucks, or may include bicycles, and so on. Further, the street intersection may include more than one IoT sensor to measure traffic data. Also, as discussed above, the one or more IoT sensors may be part of an operating cell at the intersection. Furthermore, the operating cell may be part of an IoT network of multiple operating cells disposed at multiple street intersections, respectively. The operating cells and their respective IoT sensors and devices may cooperate and share information among the operating cells with one of the cells being a primary controller cell of the network in certain examples. The data and information may be stored in memory on the sensors, traffic lights, an aggregation device, server, remote computing device, and the like.

At block 504, a computing device, gateway, or aggregation device, etc. may receive the traffic data. At block 506, the traffic data related to the street intersection and collected via the IoT sensor is analyzed a computing device, gateway, aggregation device, or traffic analyzer to assess traffic flow and/or determine a traffic event. The traffic event may be clear or no traffic, light traffic, heavy traffic or traffic congestion, a hazardous event, an event averse to traffic flow, an event conducive to traffic flow, and the like. The analysis may be based on traffic data from multiple IoT sensors from a single operating cell at an intersection from or multiple operating cells at multiple respective street intersections, and so forth. Further, as discussed. the sensor, traffic light, or computing device at the intersection may be configured as a gateway or primary controller gateway.

At block 508, a computing device such as an IoT gateway issues a response based on the analysis of the traffic data and/or on the determined traffic event. As mentioned, the traffic event can be characterized by traffic flow such as light traffic or congested traffic. The issuing of a response may include sending a timing instruction to a traffic light at the street intersection, and/or to a traffic light at another street intersection. Moreover, in one example, the traffic event is an accident, and the response is a warning issued to a wireless device in a vehicle.

In general, as discussed, the traffic data collected via the sensors by each operational cell may be assessed at a computing device (e.g., aggregation device, traffic light, sensor, server, etc.) at the primary controller operational cell or other location. An intent of the method 500 may be to prevent or reduce traffic jams and congestion, to facilitate passage of emergency vehicles, and the like.

Figure 6:
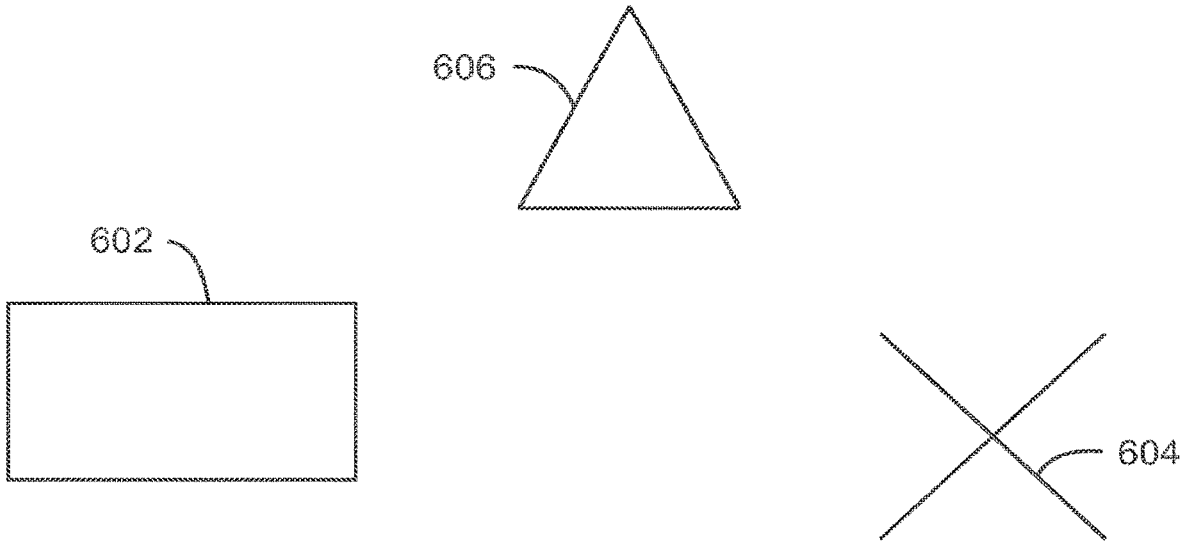
FIG. 6 is a diagram of a traffic scenario in accordance with embodiments of the present techniques.

FIG. 6 is a traffic scenario 600 in which a vehicle 602 is moving on a road toward a traffic event 604. As discussed below, a computing device 606 (e.g., traffic warning sign gateway, traffic light, aggregation device, etc.) may provide a traffic warning of the traffic event 604. The traffic warning is wirelessly broadcast such that the vehicle 602 can receive the traffic warning from the computing device 606. In contrast, for a typical driver of a vehicle 602, conventional detection (e.g., sight) of a traffic event 604 or of a traditional warning sign disposed before the traffic event 604 may not be straightforward such as when vehicle 602 is traveling in fog or snow, or at night.

In some embodiments, a warning sign as a computing device 606 having wireless capability may be placed near or ahead of the traffic event 604 such as on the side of the road (e.g., 100 meters before the traffic event 604). The warning sign (e.g., portable or temporary sign) or other warning device may wirelessly broadcast an alert and information of the traffic event 604 that may be received by a computing device in the vehicle 602. The computing device in the vehicle 602 may be a smartphone or tablet, or may be a computing component of the vehicle 602 itself. The traffic event 604 may be a traffic accident, adverse weather condition, hazardous event, or other traffic events. Moreover, again, traditional manual warning signs may not effectively capture the attention of the driver. Conversely, the warning broadcast with examples of the present techniques may be generally read by a computing device in the vehicle 602, including in fog or snow, or at night.

In certain embodiments, a wireless identification or specific SSID for Wi-Fi is broadcast by the warning device 606. A service set identifier (SSID) is a case sensitive, 32 alphanumeric character unique identifier attached to the header of packets sent over a wireless local-area network (WLAN). The SSID may act as a password when a mobile device tries to connect to the basic service set. The computing device 606 as a warning device may be an IoT-device warning sign or broadcaster that emits the specific SSID for the traffic event 604. The vehicle 602 or occupant computing devices (e.g., smartphone, tablet, etc.) in the vehicle 602 can learn of the traffic event 604 and related traffic status by scanning for the wireless identification or Wi-Fi SSID. Again, certain embodiments may define an SSID by Wi-Fi for the warning computing device 606 and traffic event 604 to broadcast an alert such as text or audio that informs drivers of the traffic event 604 and traffic status generally. Machines, such as a smartphone or vehicle computer, in the vehicle 602 can scan Wi-Fi channels to connect and receive the alert.

Indeed, a mobile device in the vehicle 602 may receive the traffic warning or traffic alert from the computing device 606, and with the mobile device including a smartphone, tablet, smartwatch, or computer glasses, and so on. Also, as indicated, the device of the vehicle 602 that receives the traffic alert may be, for example, a vehicle 602 computing device. If so, the information of the traffic alert may be audio over vehicle 602 speakers or text on a dashboard display of the vehicle 602, and so forth.

Figure 7:
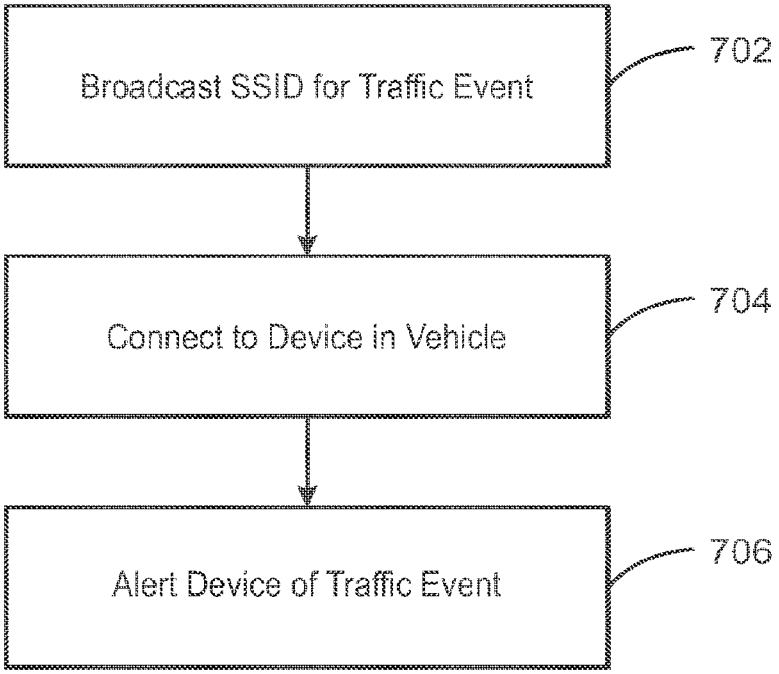
FIG. 7 is a block flow diagram of a method of traffic management in accordance with embodiments of the present techniques.

FIG. 7 is a method 700 of traffic management. At block 702, a computing device such as an IoT device broadcasts a wireless identification or SSID for a traffic event. The computing device may be a warning device disposed near or upstream of the traffic event. The SSID may be for a wireless voice or text alert of the traffic event. At block 704, the warning computing device disposed local to (e.g., near or before) the traffic event, such as on the side of the road, may wirelessly connect with a computing device (e.g., smartphone, vehicle computer system, etc.) in a vehicle approaching the traffic event. In other words, the computing device in the vehicle may scan and rely on the broadcast SSID to wirelessly connect with warning computing device. At block 706, the warning computing device may alert the computing device in the vehicle of the traffic event. The alert may be audio, video, text, and so on. The alert may range from a simple beep to a detailed alert including information describing the traffic event, instructions how to proceed with respect to the traffic event, and so forth. The traffic event may be a vehicle accident, a closed road, an obstruction on the road, unsafe road conditions, and the like.

Figure 8:
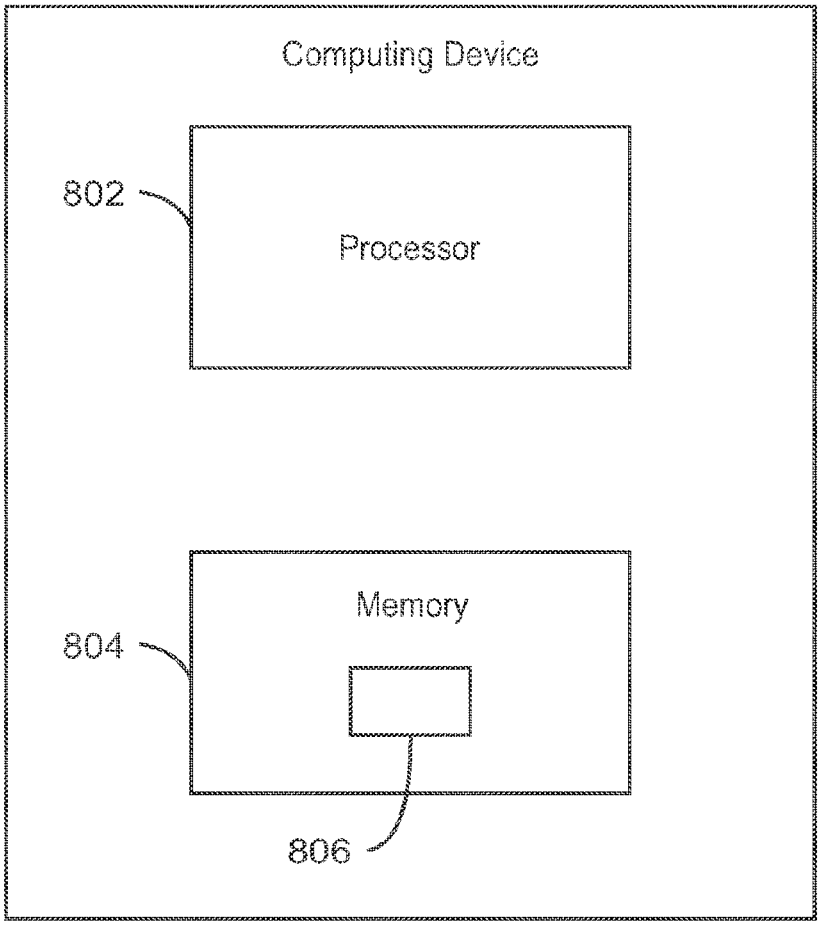
FIG. 8 is a diagram of a computing device for traffic management in accordance with embodiments of the present techniques.

FIG. 8 is a computing device 800, such as a computing system, server, aggregation device, sensor, remote computer, traffic light, warning sign, warning device, and the like. While FIG. 8 depicts one computing device 800, embodiments may employ multiple computing devices 800. The computing device 800 includes a processor or hardware processor 802 such as a microprocessor, a central processing unit or CPU, and so forth. The processor 802 may be multiple processors, and each processor 802 may have multiple cores. The computing device 800 has memory 804, such as non-volatile memory, volatile memory, and other types of memory. The nonvolatile memory may be a hard drive, read-only-memory or ROM, etc. The volatile memory may be random access memory or RAM, cache, etc.

In the illustrated example, the memory 804 stores code 806, e.g., instructions, logic, etc., executable by the one or more processors 802. The code 806 may be executed by the processor 802 to implement the traffic management techniques discussed herein. Further, respective actions may be implemented by different computing devices 800. Furthermore, while FIG. 8 represents a device 800 such as an aggregation device, server, remote computing device, etc., the processor(s) 802 and memory 804 having the stored executable code 806 may instead or additionally be in a distributed computing system such as across multiple compute nodes. Also, the computing device may include an application-specific integrated circuit (ASIC) customized for the techniques described. Lastly, the code 806 or ASIC may include a traffic analyzer, response issuer, gateway, primary controller gateway, sensor, warning system, and so forth.

Figure 9:
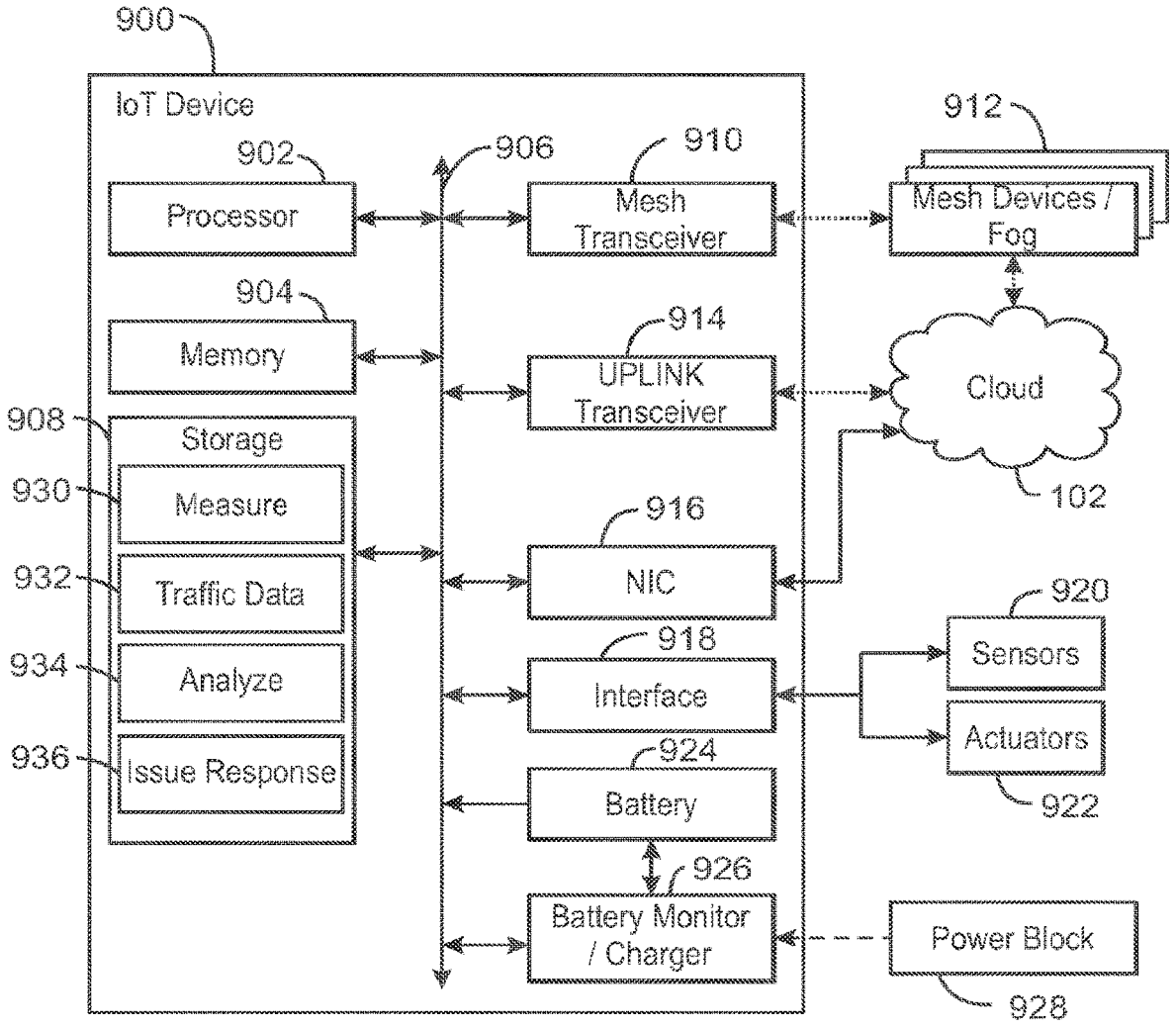
FIG. 9 is a diagram of a computing device for traffic management in accordance with embodiments of the present techniques.

FIG. 9 is a block diagram of an example of components that may be present in an IoT device 900 for profiling or diagnostics of an IoT system. The IoT device 900 may include any combinations of the components shown in the example. The components may be implemented as ICs, portions thereof, discrete electronic devices, or other modules, logic, hardware, software, firmware, or a combination thereof adapted in the IoT device 900, or as components otherwise incorporated within a chassis of a larger system. The block diagram of FIG. 9 is intended to show a high level view of components of the IoT device 900. However, some of the components shown may be omitted, additional components may be present, and different arrangements of the components shown may occur in other implementations.

The IoT device 900 may include a processor 902, which may be a microprocessor, a multi-core processor, a multi-threaded processor, an ultra-low voltage processor, an embedded processor, or other known processing element. The processor 902 may be a part of a system on a chip (SoC) in which the processor 902 and other components are formed into a single integrated circuit, or a single package, such as the Edison™ or Galileo™ SoC boards from Intel. As an example, the processor 902 may include an Intel® Architecture Core™ based processor, such as a Quark™, an Atom™, an i3, an i5, an i7, or an MCU-class processor, or another such processor available from Intel® Corporation, Santa Clara, Calif. However, any number of other processors may be used, such as those available from Advanced Micro Devices, Inc. (AMD) of Sunnyvale, Calif., a MIPS-based design from MIPS Technologies, Inc. of Sunnyvale, Calif., an ARM-based design licensed from ARM Holdings, Ltd. or customer thereof, or their licensees or adopters. The processors may include units such as an A5-A9 processor from Apple® Inc., a Snapdragon™ processor from Qualcomm® Technologies, Inc., or an OMAP™ processor from Texas Instruments, Inc.

The processor 902 may communicate with a system memory 904 over a bus 906. Any number of memory devices may be used to provide for a given amount of system memory. As examples, the memory can be random access memory (RAM) in accordance with a Joint Electron Devices Engineering Council (JEDEC) low power double data rate (LPDDR)-based design such as the current LPDDR2 standard according to JEDEC JESD 209-2E (published April 2009), or a next generation LPDDR standard, such as LPDDR3 or LPDDR4 that will offer extensions to LPDDR2 to increase bandwidth. In various implementations the individual memory devices may be of any number of different package types such as single die package (SDP), dual die package (DDP) or quad die package (Q17P). These devices, in some embodiments, may be directly soldered onto a motherboard to provide a lower profile solution, while in other embodiments the devices are configured as one or more memory modules that in turn couple to the motherboard by a given connector. Any number of other memory implementations may be used, such as other types of memory modules, e.g., dual inline memory modules (DIMMs) of different varieties including but not limited to microDIMMs or MiniDIMMs. For example, a memory may be sized between 2 GB and 16 GB, and may be configured as a DDR3LM package or an LPDDR2 or LPDDR3 memory, which is soldered onto a motherboard via a ball grid array (BGA).

To provide for persistent storage of information such as data, applications, operating systems and so forth, a mass storage 908 may also couple to the processor 902 via the bus 906. To enable a thinner and lighter system design, the mass storage 908 may be implemented via a solid state disk drive (SSDD). Other devices that may be used for the mass storage 908 include flash memory cards, such as SD cards, microSD cards, xD picture cards, and the like, and USB flash drives. In low power implementations, the mass storage 908 may be on-die memory or registers associated with the processor 902. However, in some examples, the mass storage 908 may be implemented using a micro hard disk drive (HDD). Further, any number of new technologies may be used for the mass storage 908 in addition to, or instead of, the technologies described, such as resistance change memories, phase change memories, holographic memories, or chemical memories, among others. For example, the IoT device 900 may incorporate the 3D XPOINT memories from Intel® and Micron®.

The components may communicate over the bus 906. The bus 906 may include any number of technologies, including industry standard architecture (ISA), extended ISA (EISA), peripheral component interconnect (PCI), peripheral component interconnect extended (PCIx), PCI express (PCIe), or any number of other technologies. The bus 906 may be a proprietary bus, for example, used in a SoC based system. Other bus systems may be included, such as an I2C interface, an SPI interface, point to point interfaces, and a power bus, among others.

The bus 906 may couple the processor 902 to a mesh transceiver 910, for communications with other mesh devices 912. The mesh transceiver 910 may use any number of frequencies and protocols, such as 2.4 gigahertz (GHz) transmissions under the IEEE 802.15.4 standard, using the Bluetooth® low energy (BLE) standard, as defined by the Bluetooth® Special Interest Group, or the ZigBee® standard, among others. Any number of radios, configured for a particular wireless communication protocol, may be used for the connections to the mesh devices 912. For example, a WLAN unit may be used to implement Wi-Fi™ communications in accordance with the Institute of Electrical and Electronics Engineers (IEEE) 802.11 standard. In addition, wireless wide area communications, e.g., according to a cellular or other wireless wide area protocol, can occur via a WWAN unit.

The mesh transceiver 910 may communicate using multiple standards or radios for communications at different ranges. For example, the IoT device 900 may communicate with close devices, e.g., within about 10 meters, using a local transceiver based on BLE, or another low power radio, to save power. More distant mesh devices 912, e.g., within about 50 meters, may be reached over ZigBee or other intermediate power radios. Both communications techniques may take place over a single radio at different power levels, or may take place over separate transceivers, for example, a local transceiver using BLE and a separate mesh transceiver using ZigBee. The mesh transceiver 910 may be incorporated into an MCU as an address directly accessible by the chip, such as in the Curie® units available from Intel.

An uplink transceiver 914 may be included to communicate with devices in the cloud 102. The uplink transceiver 914 may be LPWA transceiver that follows the IEEE 802.15.4, or IEEE 802.15.4g standards, among others. The IoT device 900 may communicate over a wide area using LoRaWAN™ (Long Range Wide Area Network) developed by Semtech and the LoRa Alliance. The techniques described herein are not limited to these technologies, but may be used with any number of other cloud transceivers that implement long range, low bandwidth communications, such as Sigfox, and other technologies. Further, other communications techniques, such as time-slotted channel hopping, described in IEEE 802.15.4e may be used.

Any number of other radio communications and protocols may be used in addition to the systems mentioned for the mesh transceiver 910 and uplink transceiver 914, as described herein. For example, the mesh transceiver 910 and uplink transceiver 914 may include an LTE or other cellular transceiver that uses spread spectrum (SPA/SAS) communications for implementing high speed communications, such as for video transfers. Further, any number of other protocols may be used, such as Wi-Fi networks for medium speed communications, such as still pictures, sensor readings, and provision of network communications.

The mesh transceiver 910 and uplink transceiver 914 may include radios that are compatible with any number of 3GPP (Third Generation Partnership Project) specifications, notably Long Term Evolution (LTE), Long Term Evolution-Advanced (LTE-A), and Long Term Evolution-Advanced Pro (LTE-A Pro). It can be noted that radios compatible with any number of other fixed, mobile, or satellite communication technologies and standards may be selected. These may include, for example, any Cellular Wide Area radio communication technology, which may include e.g. a 5th Generation (5G) communication systems, a Global System for Mobile Communications (GSM) radio communication technology, a General Packet Radio Service (GPRS) radio communication technology, or an Enhanced Data Rates for GSM Evolution (EDGE) radio communication technology. Other Third Generation Partnership Project (3GPP) radio communication technology that may be used includes UMTS (Universal Mobile Telecommunications System), FOMA (Freedom of Multimedia Access), 3GPP LTE (Long Term Evolution), 3GPP LTE Advanced (Long Term Evolution Advanced), 3GPP LTE Advanced Pro (Long Term Evolution Advanced Pro)), CDMA2000 (Code division multiple access 2000), CDPD (Cellular Digital Packet Data), Mobitex, 3G (Third Generation), CSD (Circuit Switched Data), HSCSD (High-Speed Circuit-Switched Data), UMTS (3G) (Universal Mobile Telecommunications System (Third Generation)), W-CDMA (UMTS) (Wideband Code Division Multiple Access (Universal Mobile Telecommunications System)), HSPA (High Speed Packet Access), HSDPA (High-Speed Downlink Packet Access), HSUPA (High-Speed Uplink Packet Access), HSPA+ (High Speed Packet Access Plus), UMTS-TDD (Universal Mobile Telecommunications System—Time-Division Duplex), TD-CDMA (Time Division—Code Division Multiple Access), TD-SCDMA (Time Division—Synchronous Code Division Multiple Access), 3GPP Rel. 8 (Pre-4G) (3rd Generation Partnership Project Release 8 (Pre-4th Generation)), 3GPP Rel. 9 (3rd Generation Partnership Project Release 9), 3GPP Rel. 10 (3rd Generation Partnership Project Release 10), 3GPP Rel. 11 (3rd Generation Partnership Project Release 11), 3GPP Rel. 12 (3rd Generation Partnership Project Release 12), 3GPP Rel. 13 (3rd Generation Partnership Project Release 13), 3GPP Rel. 14 (3rd Generation Partnership Project Release 14), 3GPP LTE Extra, LTE Licensed-Assisted Access (LAA), UTRA (UMTS Terrestrial Radio Access), E-UTRA (Evolved UMTS Terrestrial Radio Access), LTE Advanced (4G) (Long Term Evolution Advanced (4th Generation)), cdmaOne (2G), CDMA2000 (3G) (Code division multiple access 2000 (Third generation)), EV-DO (Evolution-Data Optimized or Evolution-Data Only), AMPS (1G) (Advanced Mobile Phone System (1st Generation)), TACS/ETACS (Total Access Communication System/Extended Total Access Communication System), D-AMPS (2G) (Digital AMPS (2nd Generation)), PTT (Push-to-talk), MTS (Mobile Telephone System), IMTS (Improved Mobile Telephone System), AMTS (Advanced Mobile Telephone System), OLT (Norwegian for Offentlig Landmobil Telefoni, Public Land Mobile Telephony), MTD (Swedish abbreviation for Mobiltelefonisystem D, or Mobile telephony system D), Autotel/PALM (Public Automated Land Mobile), ARP (Finnish for Autoradiopuhelin, "car radio phone"), NMT (Nordic Mobile Telephony), Hicap (High capacity version of NTT (Nippon Telegraph and Telephone)), CDPD (Cellular Digital Packet Data), Mobitex, DataTAC, iDEN (Integrated Digital Enhanced Network), PDC (Personal Digital Cellular), CSD (Circuit Switched Data), PHS (Personal Handy-phone System), WiDEN (Wideband Integrated Digital Enhanced Network), iBurst, Unlicensed Mobile Access (UMA, also referred to as also referred to as 3GPP Generic Access Network, or GAN standard)), Wireless Gigabit Alliance (WiGig) standard, mmWave standards in general (wireless systems operating at 10-90 GHz and above such as WiGig, IEEE 802.11ad, IEEE 802.11ay, and the like. In addition to the standards listed above, any number of satellite uplink technologies may be used for the uplink transceiver 914, including, for example, radios compliant with standards issued by the ITU (International Telecommunication Union), or the ETSI (European Telecommunications Standards Institute), among others. The examples provided herein are thus understood as being applicable to various other communication technologies, both existing and not yet formulated.

A network interface controller (NIC) 916 may be included to provide a wired communication to the cloud 102. The wired communication may provide an Ethernet connection, or may be based on other types of networks, such as Controller Area Network (CAN), Local Interconnect Network (LIN), DeviceNet, ControlNet, Data Highway+, PROFIBUS, or PROFINET, among many others. An additional NIC 916 may be included to allow connection to a second network, for example, a NIC 916 providing communications to the cloud over Ethernet, and a second NIC 916 providing communications to other devices over another type of network.

The bus 906 may couple the processor 902 to an interface 918 that may be used to connect external devices. The external devices may include sensors 920, such as accelerometers, level sensors, flow sensors, temperature sensors, pressure sensors, barometric pressure sensors, and the like. The interface 918 may be used to connect the IoT device 900 to actuators 922, such as power switches, valve actuators, an audible sound generator, a visual warning device, and the like.

While not shown, various input/output (I/O) devices may be present within, or connected to, the IoT device 900. For example, a display may be included to show information, such as sensor readings or actuator position. An input device, such as a touch screen or keypad may be included to accept input.

A battery 924 may power the IoT device 900, although in examples in which the IoT device 900 is mounted in a fixed location, it may have a power supply coupled to an electrical grid. The battery 924 may be a lithium ion battery, a metal-air battery, such as a zinc-air battery, an aluminum-air battery, a lithium-air battery, and the like.

A battery monitor/charger 926 may be included in the IoT device 900 to track the state of charge (SoCh) of the battery 924. The battery monitor/charger 926 may be used to monitor other parameters of the battery 924 to provide failure predictions, such as the state of health (SoH) and the state of function (SoF) of the battery 924. The battery monitor/charger 926 may include a battery monitoring integrated circuit, such as an LTC4020 or an LTC2990 from Linear Technologies, an ADT7488A from ON Semiconductor of Phoenix Ariz., or an IC from the UCD90xxx family from Texas Instruments of Dallas, Tex. The battery monitor/charger 926 may communicate the information on the battery 924 to the processor 902 over the bus 906. The battery monitor/charger 926 may also include an analog-to-digital (ADC) convertor that allows the processor 902 to directly monitor the voltage of the battery 924 or the current flow from the battery 924. The battery parameters may be used to determine actions that the IoT device 900 may perform, such as transmission frequency, mesh network operation, sensing frequency, and the like. This may be related back to the failure operations being performed discussed above.

A power block 928, or other power supply coupled to a grid, may be coupled with the battery monitor/charger 926 to charge the battery 924. In some examples, the power block 928 may be replaced with a wireless power receiver to obtain the power wirelessly, for example, through a loop antenna in the IoT device 900. A wireless battery charging circuit, such as an LTC4020 chip from Linear Technologies of Milpitas, Calif., among others, may be included in the battery monitor/charger 926. The specific charging circuits chosen depend on the size of the battery 924, and thus, the current required. The charging may be performed using the Airfuel standard promulgated by the Airfuel Alliance, the Qi wireless charging standard promulgated by the Wireless Power Consortium, the Rezence charging standard, promulgated by the Alliance for Wireless Power, among others.

The mass storage 908 may include a number of modules to implement the traffic management described herein, as indicated by reference numerals 930, 932, 934, and 936. Block 930 may be executable code to facilitate measurement and collection of traffic data of vehicular traffic such as at an intersection of streets. Block 932 may be the traffic data stored in the memory storage 908. Block 934 may be executable code stored to analyze the traffic data. Block 936 may be executable code to formulate, store, and issue a response based on the analysis of the traffic data.

Although shown as code blocks in the mass storage 908, it may be understood that any of the modules may be replaced with hardwired circuits, for example, built into an application specific integrated circuit (ASIC). The mass storage 908 may further include and store other functional blocks, such as a control UI for accessing configuration parameters, and an automation framework that may provide application program interfaces (APIs) for the interaction of canned trigger scripts. Other functional blocks that may be present include accelerated processing units (APUs) in the automation framework that exchange a standard set of timing information that allows trigger scripts to identify synchronous versus staggered starts. An IoT database may be includes to store workflow configuration information, observed system performance, and resulting solution characteristics. Interactions with the IoT database may be via the control UI.

Figure 10:
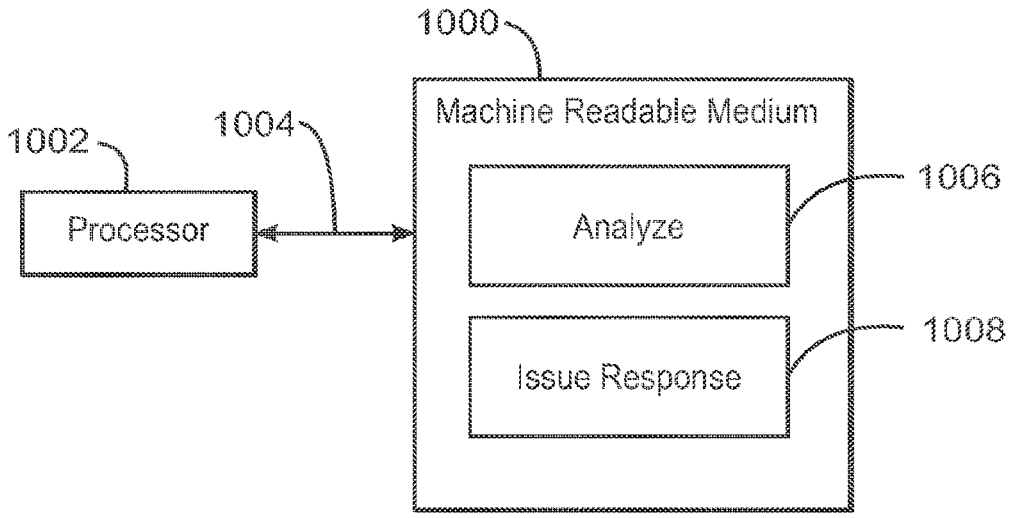
FIG. 10 is a block diagram illustrating a computer-readable medium to facilitate traffic management in accordance with embodiments of the present techniques.

FIG. 10 is a block diagram depicting a tangible, non-transitory, computer-readable medium to facilitate profiling and diagnostics. The computer-readable medium 1000 may be accessed by a processor 1002 over a computer interconnect 1004. The processor 1002 may be an aggregation device processor, a sensor processor, a server processor, a remote computing device processor, or other processor. The tangible, non-transitory, computer-readable medium 100 may include executable instructions or code to direct the 1002 to perform the operations of the techniques described herein, such as to implement traffic management.

The various software components discussed herein may be stored on the tangible, non-transitory, computer-readable medium 1000, as indicated in FIG. 10. For example, an analyze module 1006 (executable code/instructions) may direct the processor 1002 to analyze traffic data. A module 1008 to issue a response may direct the processor 1002 to issue a response based on results of the analysis of the traffic data. It should be understood that any number of additional software components not shown in FIG. 10 may be included within the tangible, non-transitory, computer-readable medium 1000, depending on the application.

In some examples, a tangible, non-transitory, computer-readable medium stores code executable by a processor to direct the processor to receive traffic data of vehicular traffic measured via an IoT sensor, analyze the traffic data to determine a traffic event, and issue a response based on the traffic event. The traffic event may be traffic flow, and wherein to issue a response includes to send a timing instruction to a traffic light. In another example, the traffic event is a hazardous event, and wherein to issue a response includes to provide a warning of the traffic event to a wireless device in a vehicle.

In the description and claims, the terms "coupled" and "connected", along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit or receive signals, among others.

An embodiment is an implementation or example. Reference in the specification to "an embodiment", "one embodiment", "some embodiments", "various embodiments", or "other embodiments" means that a particular feature, structure, or characteristic described in connection with the embodiments is included in at least some embodiments, but not necessarily all embodiments, of the present techniques. The various appearances of "an embodiment", "one embodiment", or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can", or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement or order of circuit elements or other features illustrated in the drawings or described herein need not be arranged in the particular way illustrated and described. Many other arrangements are possible according to some embodiments.

In each system shown in a figure, the elements in some cases may each have a same reference number or a different reference number to suggest that the elements represented could be different or similar. However, an element may be flexible enough to have different implementations and work with some or all of the systems shown or described herein. The various elements shown in the figures may be the same or different. Which one is referred to as a first element and which is called a second element is arbitrary.

Examples are given. Example 1 is an Internet of Things (IoT) system for vehicular traffic management. The system includes an IoT sensor to measure traffic data of vehicular traffic; a traffic analyzer to determine a traffic event based on the traffic data; and an IoT gateway to issue a response based on the traffic event.

Example 2 includes the system of example 1, including or excluding optional features. In this example, the IoT sensor to measure the traffic data of vehicular traffic at an intersection of streets, wherein the traffic event comprises traffic flow, and wherein the response comprises a timing instruction issued to a traffic light at the intersection.

Example 3 includes the system of any one of examples 1 to 2, including or excluding optional features. In this example, the traffic event comprises a hazardous event, and wherein the response comprises issuing a warning of the traffic event, the warning receivable by a wireless device in a vehicle.

Example 4 includes the system of any one of examples 1 to 3, including or excluding optional features. In this example, the system includes a first operational cell comprising the IoT sensor and the IoT gateway, the first operational cell disposed at a first intersection of streets, the IoT sensor to measure traffic data of vehicular traffic at the first intersection; and a second operational cell communicatively coupled to the first operational cell, the second operational cell disposed at a second intersection of streets and comprising a second IoT sensor and a second IoT gateway, the second IoT sensor to measure traffic data of vehicular traffic at the second intersection, wherein the traffic analyzer to determine the traffic event based on the traffic data measured at the first intersection and the second intersection.

Example 5 includes the system of any one of examples 1 to 4, including or excluding optional features. In this example, the traffic analyzer comprises a processor and memory storing code executable by the processor to determine the traffic event based on the traffic data.

Example 6 includes the system of any one of examples 1 to 5, including or excluding optional features. In this example, the IoT gateway comprises a processor and memory storing code executable by the processor to issue the response based on the traffic event, and wherein the IoT gateway comprises a primary controller IoT gateway.

Example 7 includes the system of any one of examples 1 to 6, including or excluding optional features. In this example, the IoT gateway comprises the traffic analyzer.

Example 8 is a method of traffic management via an Internet of Things (IoT) system. The method includes measuring, via an IoT sensor, traffic data of vehicular traffic; analyzing, via a computing device, the traffic data to determine a traffic event; and issuing, via an IoT gateway device, a response based on the traffic event.

Example 9 includes the method of example 8, including or excluding optional features. In this example, the traffic data comprises traffic data of vehicular traffic at an intersection of streets, wherein the traffic event comprises traffic congestion, and wherein issuing a response comprises sending a timing instruction to a traffic light.

Example 10 includes the method of any one of examples 8 to 9, including or excluding optional features. In this example, the traffic event comprises an accident, and wherein issuing a response comprises issuing a warning of the traffic event to a wireless device in a vehicle.

Example 11 includes the method of any one of examples 8 to 10, including or excluding optional features. In this example, a first operational cell comprises the IoT sensor and the IoT gateway device, the first operational cell disposed at a first intersection of streets, and further comprising providing the traffic data from the first operational cell to a second operational cell disposed at a second intersection of streets.

Example 12 includes the method of any one of examples 8 to 11, including or excluding optional features. In this example, a first operational cell comprises the IoT sensor and the IoT gateway device, the first operational cell disposed at a first intersection of streets, and further comprising receiving at the first operational cell additional traffic data regarding a second intersection of streets from a second operational cell disposed at the second intersection of streets, and wherein analyzing traffic data comprises analyzing the traffic data and the additional traffic data.

Example 13 includes the method of any one of examples 8 to 12, including or excluding optional features. In this example, the IoT gateway device comprises the computing device analyzing the traffic flow.

Example 14 is an IoT gateway device for traffic management. The device includes a processor; and memory storing code executable by the processor to: receive traffic data of vehicular traffic measured via an IoT sensor; analyze the traffic data; and issue a response based on the traffic data.

Example 15 includes the device of example 14, including or excluding optional features. In this example, to analyze the traffic data comprises to assess traffic flow, and wherein to issue a response comprises to send a timing instruction to a traffic light.

Example 16 includes the device of any one of examples 14 to 15, including or excluding optional features. In this example, to analyze the traffic data comprises to identify an event averse to traffic flow, and wherein to issue a response comprises to provide a warning of the event to a wireless device in a vehicle.

Example 17 is an Internet of Things (IoT) network of operational cells for vehicular traffic management. The Internet of Things (IoT) network of operational cells for vehicular traffic management includes a first operational cell disposed at a first intersection of streets, the first operational cell comprising a first traffic light and a first IoT sensor to measure traffic data of vehicular traffic at the first intersection; a second operational cell disposed at a second intersection of streets different than the first intersection, the second operational cell communicatively coupled to the first operational cell and comprising a second traffic light and a second IoT sensor to measure traffic data of vehicular traffic at the second intersection; and a computing device to determine traffic-light timing instructions for the first traffic light and the second traffic light based on a combination of the traffic data measured at the first intersection and the second intersection.

Example 18 includes the IoT network of example 17, including or excluding optional features. In this example, the first operational cell comprises the computing device.

Example 19 includes the IoT network of any one of examples 17 to 18, including or excluding optional features. In this example, an IoT gateway device comprises the computing device.

Example 20 includes the IoT network of any one of examples 17 to 19, including or excluding optional features. In this example, the computing device is remote from the first intersection and the second intersection.

Example 21 includes the IoT network of any one of examples 17 to 20, including or excluding optional features. In this example, the first operational cell is a primary controller operational cell of the IoT network, and wherein the second operational cell is a secondary controlled operational cell of the IoT network Example 22 includes the of any one of examples 17 to 21, including or excluding optional features. In this example, the first operational cell comprises a first plurality of traffic lights at the first intersection and a first plurality of IoT sensors to measure traffic data of vehicular traffic at the first intersection; and the second operational cell comprises a second plurality of traffic lights at the second intersection and a second plurality of IoT sensors to measure traffic data of vehicular traffic at the second intersection, wherein the computing device to determine traffic-light timing instructions for the first plurality of traffic lights and the second plurality of traffic lights.

Example 23 includes the IoT network of any one of examples 17 to 22, including or excluding optional features. In this example, the computing device to determine the traffic-light timing instructions to clear a route for an emergency vehicle.

Example 24 includes the IoT network of any one of examples 17 to 23, including or excluding optional features. In this example, the first intersection of streets and the second intersection of streets comprise a main street, and wherein the first operational cell and the second operational cell cooperate to maintain primary traffic flow along the main street. Optionally, operating topology of the IoT network to change as a function of the traffic data, comprising to maintain primary traffic flow along a street of the first intersection or the second intersection other than the main street.

Example 25 is a tangible, non-transitory, computer-readable medium. The computer-readable medium includes instructions that direct the processor to receive traffic data of vehicular traffic measured via an IoT sensor; analyze the traffic data to determine a traffic event; and issue a response based on the traffic event.

Example 26 includes the computer-readable medium of example 25, including or excluding optional features. In this example, the traffic event comprises a conclusion about traffic flow, and wherein to issue a response comprises to send a timing instruction to a traffic light. Optionally, the traffic event comprises a hazardous event, and wherein to issue a response comprises to provide a warning of the traffic event to a wireless device in a vehicle.

Example 27 is an Internet of Things (IoT) network of operational cells for vehicular traffic management. The Internet of Things (IoT) network of operational cells for vehicular traffic management includes instructions that direct the processor to a first operational cell disposed at a first intersection of streets, the first operational cell comprising a first traffic light and a first IoT sensor to measure traffic data of vehicular traffic at the first intersection, wherein the first operational cell is a primary controller operational cell of the IoT network; a second operational cell disposed at a second intersection of streets different than the first intersection, the second operational cell communicatively coupled to the first operational cell and comprising a second traffic light and a second IoT sensor to measure traffic data of vehicular traffic at the second intersection, wherein the second operational cell is a secondary controlled operational cell of the IoT network; and a computing device to determine traffic-light timing instructions for the first traffic light and the second traffic light based on a combination of the traffic data measured at the first intersection and the second intersection.

Example 28 includes the IoT network of example 27, including or excluding optional features. In this example, the first operational cell comprises the computing device, or wherein the computing device is remote from the first intersection and the second intersection.

Example 29 includes the IoT network of any one of examples 27 to 28, including or excluding optional features. In this example, an IoT gateway device comprises the computing device. Optionally, the computing device to determine the traffic-light timing instructions to clear a route for an emergency vehicle. Optionally, the first intersection of streets and the second intersection of streets comprise a main street, and wherein the first operational cell and the second operational cell cooperate to maintain primary traffic flow along the main street. Optionally, operating topology of the IoT network to change as a function of the traffic data, comprising to maintain primary traffic flow along a street of the first intersection or the second intersection other than the main street.

Example 30 is a traffic management system. The system includes means for measuring traffic data of vehicular traffic; means for analyzing the traffic data to determine a traffic event; and means for issuing a response based on the traffic event.

Example 31 includes the system of example 30, including or excluding optional features. In this example, the traffic data comprises traffic data of vehicular traffic at an intersection of streets, wherein the traffic event comprises an event beneficial or averse to traffic flow, and wherein issuing a response comprises sending a timing instruction to a traffic light. Optionally, the traffic event comprises an accident, and wherein issuing a response comprises issuing a warning of the traffic event to a wireless device in a vehicle.

Example 32 includes the system of any one of examples 30 to 31, including or excluding optional features. In this example, a first operational cell comprises the means for measuring traffic data and the means for issuing a response, the first operational cell disposed at a first intersection of streets, and further comprising means for providing the traffic data from the first operational cell to a second operational cell disposed at a second intersection of streets.

Example 33 includes the system of any one of examples 30 to 32, including or excluding optional features. In this example, a first operational cell comprises the means for measuring traffic data and the means for issuing a response, the first operational cell disposed at a first intersection of streets, and further comprising means for receiving at the first operational cell additional traffic data regarding a second intersection of streets from a second operational cell disposed at the second intersection of streets, and wherein the means for analyzing traffic data comprises means for analyzing the traffic data and the additional traffic data.

Example 34 includes the system of any one of examples 30 to 33, including or excluding optional features. In this example, the means for issuing a response comprises the means for analyzing the traffic data.

Example 35 includes the system of any one of examples 30 to 34, including or excluding optional features. In this example, the means for issuing a response comprises means for aggregating data from the means for measuring traffic.

Example 36 includes the system of any one of examples 30 to 35, including or excluding optional features. In this example, the means for measuring traffic data comprises means for measuring traffic data of vehicular traffic via an IoT sensor.

Example 37 is a computing device comprising an alert implementer to transmit wirelessly to a wireless device in a vehicle a wireless traffic warning related to a traffic event.

Example 38 includes the computing device of example 37, including or excluding optional features. In this example, the computing device is an IoT gateway device at a street intersection.

Example 39 includes the computing device of any one of examples 37 to 38, including or excluding optional features. In this example, the computing device is a warning sign device.

Example 40 includes the computing device of any one of examples 37 to 39, including or excluding optional features.

In this example, to transmit comprises to transmit via a low-power, low-range wireless protocol.

Example 41 includes the computing device of any one of examples 37 to 40, including or excluding optional features. In this example, to transmit comprises to broadcast a wireless identification for wireless communication receivable by the wireless device in the vehicle. Optionally, the wireless identification comprises a service set identifier (SSID).

Example 42 includes the computing device of any one of examples 37 to 41, including or excluding optional features. In this example, the wireless device in the vehicle comprises a mobile device.

Example 43 includes the computing device of any one of examples 37 to 42, including or excluding optional features. In this example, the mobile device comprises a smartphone, tablet, smartwatch, or computer glasses.

Example 44 includes the computing device of any one of examples 37 to 43, including or excluding optional features. In this example, the wireless device in the vehicle comprises a vehicle computing device.

Example 45 includes the computing device of any one of examples 37 to 44, including or excluding optional features. In this example, the traffic event comprises an event averse to traffic flow.

Example 46 includes the computing device of any one of examples 37 to 45, including or excluding optional features. In this example, the traffic event comprises an accident.

Example 47 includes the computing device of any one of examples 37 to 46, including or excluding optional features. In this example, the traffic event comprises an adverse weather condition.

Example 48 includes the computing device of any one of examples 37 to 47, including or excluding optional features. In this example, the traffic event comprises a hazardous event.

Example 49 includes the computing device of any one of examples 37 to 48, including or excluding optional features. In this example, the computing device comprises a processor and memory, and wherein the alert implementer comprises code stored in the memory and executable by the processor to transmit wirelessly to the wireless device in the vehicle the wireless traffic warning related to the traffic event.

Example 50 is a method of traffic management comprising alerting of a traffic event, the method comprising transmitting wirelessly to a wireless device in a vehicle a wireless traffic warning related to the traffic event.

Example 51 includes the method of example 50, including or excluding optional features. In this example, the method includes broadcasting a wireless identification for wireless communication. Optionally, the wireless identification comprises a service set identifier (SSID).

Example 52 includes the method of any one of examples 50 to 51, including or excluding optional features. In this example, transmitting wirelessly comprising transmitting wirelessly via a warning sign device to the wireless device in the vehicle. Optionally, the method includes disposing the warning sign device local to the traffic event.

It is to be understood that specifics in the aforementioned examples may be used anywhere in one or more embodiments. For instance, all optional features of the computing device described above may also be implemented with respect to either of the methods described herein or a computer-readable medium. Furthermore, although flow diagrams or state diagrams may have been used herein to describe embodiments, the present techniques are not limited to those diagrams or to corresponding descriptions herein. For example, flow need not move through each illustrated box or state or in exactly the same order as illustrated and described herein.

The present techniques are not restricted to the particular details listed herein. Indeed, those skilled in the art having the benefit of this disclosure will appreciate that many other variations from the foregoing description and drawings may be made within the scope of the present techniques. Accordingly, it is the following claims including any amendments thereto that define the scope of the present techniques.

What is claimed is:

1. An Internet of Things (IoT) system for vehicular traffic management, comprising:

a group of IoT devices forming a mesh network, the group of IoT devices comprising transient IoT devices that are temporary members of the mesh network and permanent IoT devices comprising traffic lights, the group of IoT devices comprising an IoT sensor to measure traffic data of vehicular traffic including at least one vehicular IoT device of the transient IoT devices, the mesh network having a configuration that is reconfigured based on characteristics of the group of IoT devices and relationships between the transient IoT devices and permanent IoT devices, and at least one of the transient IoT devices or permanent IoT devices controllable based on the configuration of the mesh network, the mesh network being divided into operational cells throughout which the traffic lights are dispersed, the operational cells comprising a main operational cell;

a traffic analyzer operable for use with the mesh network, the traffic analyzer configured to determine a traffic event based on the traffic data; and an IoT gateway operable for use with the mesh network, the IoT gateway configured to issue a response based on the traffic event, the response comprising timing instructions to the traffic lights to adjust timing of the traffic lights, at least one of the traffic lights disposed at a local intersection in one of the operational cells other than the main operational cell, the at least one of the traffic lights configured to reject the response in response to a predetermined condition being met and instead rely on a timing option determined by the one of the operational cells based on local traffic data at the local intersection.

2. The IoT system of claim 1, wherein:

the IoT sensor is configured to measure the traffic data of vehicular traffic at an intersection of streets, and the traffic event comprises traffic flow.

3. The IoT system of claim 1, wherein:

the traffic event comprises a hazardous event, and the response further comprises issuing a warning of the traffic event, the warning receivable by a wireless device in a vehicle.

4. The IoT system of claim 1, further comprising:

a first operational cell of the operational cells comprising the IoT sensor and the IoT gateway, the first operational cell disposed at a first intersection of streets, the IoT sensor to measure traffic data of vehicular traffic at the first intersection; and a second operational cell of the operational cells communicatively coupled to the first operational cell, the second operational cell disposed at a second intersection of streets and comprising a second IoT sensor and a second IoT gateway, the second IoT sensor to measure traffic data of vehicular traffic at the second intersection, wherein the traffic analyzer is configured to determine the traffic event based on the traffic data measured at the first intersection and the second intersection.

5. The IoT system of claim 1, wherein control communications to at least one specific resource in the mesh network occur without identification of a controller IoT device within the mesh network that transmits the control communications, the control communications configured to permit multiple IoT devices within the group of IoT devices to discover and control the at least one specific resource in response to failure of the controller IoT device.

6. The IoT system of claim 1, wherein:

the IoT gateway comprises at least one of the traffic lights.

7. The IoT system of claim 6, wherein:

the IoT gateway is disposed in the main operational cell of the operational cells.

8. The IoT system of claim 7, wherein:

each operational cell has at least one IoT sensor, and each operational cell is configured to switch to default timing of traffic lights in the operational cell in response to a default event, the default event selected from a plurality of default events that comprise malfunction of the at least one IoT sensor, loss of connectivity to the main operational cell, and a last policy from the main operational cell indicates that the operational cell to rely on the default timing.

9. The IoT system of claim 7, wherein the main operational cell is configured to switch among the operational cells based on the traffic event.

10. The IoT system of claim 1, wherein:

the IoT gateway comprises at least one of the at least one vehicular IoT device.

11. The IoT system of claim 1, wherein at least one of the IoT devices is configured to broadcast a Service Set Identifier (SSID) specific for the traffic event.

12. A method of traffic management via an Internet of Things (IoT) system, comprising:

measuring, via an IoT sensor, traffic data of vehicular traffic, the IoT sensor being one of a group of IoT devices forming a mesh network, the mesh network comprising transient IoT devices that are temporary members of the mesh network and permanent IoT devices comprising traffic lights, the group of IoT devices including at least one vehicular IoT device of the transient IoT devices, the mesh network having a configuration that is reconfigured based on characteristics of the group of IoT devices and relationships between the transient IoT devices and permanent IoT devices, and at least one of the transient IoT devices or permanent IoT devices controllable based on the configuration of the mesh network, the mesh network being divided into operational cells throughout which the traffic lights are dispersed, the operational cells comprising a main operational cell, at least one of the traffic lights disposed at a local intersection in one of the operational cells other than the main operational cell;

analyzing, via a computing device, the traffic data to determine a traffic event;

issuing, via an IoT gateway device, a response based on the traffic event;

adjusting timing of the traffic lights based on timing instructions in the response; and rejecting, by the at least one of the traffic lights, the response in response to a predetermined condition being met and instead relying on a timing option determined by the one of the operational cells based on local traffic data at the local intersection.

13. The method of claim 12, wherein:

the traffic data comprises traffic data of vehicular traffic at an intersection of streets, and the traffic event comprises traffic congestion.

14. The method of claim 12, wherein:

the traffic event comprises an accident, and issuing the response further comprises issuing a warning of the traffic event to a wireless device in a vehicle.

15. The method of claim 12, wherein:

a first operational cell of the operational cells comprises the IoT sensor and the IoT gateway device, the first operational cell disposed at a first intersection of streets, and the method further comprises providing the traffic data from the first operational cell to a second operational cell of the operational cells disposed at a second intersection of streets.

16. The method of claim 12, wherein:

a first operational cell of the operational cells comprises the IoT sensor and the IoT gateway device, the first operational cell disposed at a first intersection of streets, the method further comprises receiving, at the first operational cell, additional traffic data regarding a second intersection of streets from a second operational cell of the operational cells disposed at the second intersection of streets, and analyzing traffic data comprises analyzing the traffic data and the additional traffic data.

17. An IoT gateway device for traffic management, comprising:

a processor; and memory storing code executable by the processor to:

receive traffic data of vehicular traffic measured via an IoT sensor, the IoT sensor being one of a group of IoT devices forming a mesh network, the mesh network comprising a group of IoT devices comprising transient IoT devices that are temporary members of the mesh network and permanent IoT devices comprising traffic lights, the temporary group of IoT devices including at least one vehicular IoT device of the transient IoT devices, the mesh network having a configuration that is reconfigured based on characteristics of the temporary group of IoT devices and relationships between the transient IoT devices and permanent IoT devices, at least one of the transient IoT devices or permanent IoT devices controllable based on the configuration of the mesh network, the mesh network being divided into operational cells throughout which the traffic lights are dispersed, the operational cells comprising a main operational cell;

analyze, at at least one of the IoT devices, the traffic data; and issue, by the at least one of the IoT devices, a response based on the traffic data, the response comprising timing instructions to the traffic lights to adjust timing of the traffic lights, at least one of the traffic lights disposed at a local intersection in one of the operational cells other than the main operational cell, the at least one of the traffic lights configured to reject the response in response to a predetermined condition being met and instead rely on a timing option determined by the one of the operational cells based on local traffic data at the local intersection.

18. The IoT gateway device of claim 17, wherein:

analysis of the traffic data comprises assessment of traffic flow.

19. The IoT gateway device of claim 17, wherein:

analysis of the traffic data comprises identification of an event averse to traffic flow, and issuance of the response further comprises transmission of a warning of the event to a wireless device in a vehicle.

20. An Internet of Things (IoT) network of operational cells for vehicular traffic management, comprising:

a first operational cell disposed at a first intersection of streets, the first operational cell comprising a first traffic light and a first IoT sensor configured to measure traffic data of vehicular traffic at the first intersection;

a second operational cell disposed at a second intersection of streets different than the first intersection, the second operational cell communicatively coupled to the first operational cell and comprising a second traffic light and a second IoT sensor configured to measure traffic data of vehicular traffic at the second intersection; and a computing device configured to determine traffic-light timing instructions for the first traffic light and the second traffic light based on a combination of the traffic data measured at the first intersection and the second intersection, each of the first and second operational cells comprising a group of IoT devices forming a mesh network, the mesh network comprising a group of IoT devices comprising transient IoT devices that are temporary members of the mesh network and permanent IoT devices comprising the first and second traffic lights, the group of IoT devices comprising the first and second IoT sensors, the mesh network comprising operational cells that include the first and second operational cells, the operational cells comprising a main operational cell, the mesh network having a configuration that is reconfigured based on characteristics of the temporary group of IoT devices and relationships between the transient IoT devices and permanent IoT devices, and at least one of the transient IoT devices or permanent IoT devices controllable based on the configuration of the mesh network, at least one of the first or second traffic light configured to reject the traffic-light timing instructions in response to a predetermined condition being met and instead rely on a timing option determined respectively by the first or second operational cell based on the traffic data at the first or second intersection.

21. The IoT network of claim 20, wherein:

the first operational cell comprises a first plurality of traffic lights at the first intersection and a first plurality of IoT sensors to measure traffic data of vehicular traffic at the first intersection, the second operational cell comprises a second plurality of traffic lights at the second intersection and a second plurality of IoT sensors to measure traffic data of vehicular traffic at the second intersection, and the computing device is further configured to determine traffic-light timing instructions for the first plurality of traffic lights and the second plurality of traffic lights.

22. The IoT network of claim 20, wherein the computing device is further configured to determine the traffic-light timing instructions to clear a route for an emergency vehicle.

23. The IoT network of claim 20, wherein:

the first intersection of streets and the second intersection of streets comprise a main street, and the first operational cell and the second operational cell cooperate to maintain primary traffic flow along the main street.

24. The IoT network of claim 20, wherein operating topology of the IoT network is configured to change as a function of the traffic data, comprising to maintain primary traffic flow along a street of the first intersection or the second intersection other than the main street.

* * * * *